US005580307A

United States Patent [19]

Arosio et al.

[11] Patent Number: 5,580,307

[45] Date of Patent: Dec. 3, 1996

[54] SHUTTER FOR AIR OR SMOKE CONDUITS

[75] Inventors: Giovanni B. Arosio, Monza; Claudio Arosio, Lissone, both of Italy

[73] Assignee: Arosio F. LLI s.n.c., Milan, Italy

[21] Appl. No.: 393,592

[22] Filed: Feb. 22, 1995

[51] Int. Cl.[6] ..... F24F 13/15

[52] U.S. Cl. ..... 454/336; 49/82.1; 137/601

[58] Field of Search ..... 454/336, 326, 454/369; 137/601, 315; 251/248; 49/82.1, 116

[56] References Cited

U.S. PATENT DOCUMENTS

| | | | |
|---|---|---|---|
| 2,499,692 | 3/1950 | Spratt | 49/82.1 |
| 2,954,590 | 10/1960 | Dynner | 49/82.1 |
| 3,084,715 | 4/1963 | Scharres | 454/336 X |
| 4,275,762 | 6/1981 | Field | 137/601 |
| 5,052,150 | 10/1991 | Chen | 49/82.1 |
| 5,216,837 | 6/1993 | Cleaver et al. | 49/82.1 |

*Primary Examiner*—Harold Joyce

*Attorney, Agent, or Firm*—Sughrue, Mion, Zinn, Macpeak & Seas

[57] ABSTRACT

The air lock includes a frame, a passage port defined by the frame, a plurality of side by side tabs supported in a rotating manner by the frame and extending through the passage port as well as kinematic connections between the tabs to ensure simultaneous and synchronized movement of each of said tabs between a closed position wherein all the tabs are essentially coplanar and close the passage port and an open position rotated by approximately 90° in relation to the closed position. The air lock is characterized in that each tab is supported by the frame by at least one supporting plate separate from the frame and inserted in a pair of tracks formed in the frame and in that the kinematic connections are housed in a space made in the frame and enclosed by the tab supporting plates.

8 Claims, 2 Drawing Sheets

SHUTTER FOR AIR OR SMOKE CONDUITS

BACKGROUND OF THE INVENTION

The present invention relates to an air lock with tabs for closing ducts for the passage of air, smoke and the like.

Air locks of this type comprise a frame, a passage port defined by the frame and a plurality of side by side tabs supported in a rotating manner by the frame and extending through the passage port. In addition there are provided kinematic connection means between the tabs to ensure simultaneous and synchronised movement of each of said tabs between a closed position wherein all the tabs are essentially coplanar and close the passage port and an open position rotated by approximately 90° in relation to the closed position.

The kinematic connection means can be provided by means of gear wheels integral in rotation with each tab and meshed directly with each other. In this manner each gear wheel rotates in the direction opposite that of the tabs adjacent thereto. As an alternative, there are employed kinematic rack or lever mechanisms of various types permitting optionally operation of all the tabs in the same rotation direction while keeping them parallel to one another.

In any case the kinematic connection means are brought together and supported on the same side of the frame, either towards the interior thereof (i.e. towards the passage port) or towards the exterior.

The choice between the two arrangements usually allows for different factors among which are the degree of environment severity, the possibility of perfect closing of the passage port, and ease of production and installation.

Indeed, an inward arrangement subjects the kinematic connection means to the flow traversing the air lock which could cause damage due to the deposit of dirt such as e.g. in a painting station or due to the corrosive effects of e.g. smoke exhaust. In addition, an inward arrangement makes perfect closing of the air lock practically impossible.

On the other hand even an outward arrangement is not free of shortcomings since even the external environment where the duct in which is inserted the air lock is located can be a source of problems due to the accumulation of dirt or even to the presence of corrosive substances. Furthermore, with an outward arrangement the utmost care must be taken to prevent foreign bodies from accidentally jamming or obstructing movement of the kinematic mechanism.

For these reasons a solution often adopted consists of positioning the kinematic connection means externally and protecting them with a special cover.

SUMMARY OF THE INVENTION

The problem underlying the present invention is to provide an air lock overcoming the above mentioned shortcomings.

Said problem is solved in accordance with the present invention by an air lock with tabs for closing ducts for the passage of air, smoke and the like and comprising a frame, a passage port defined by the frame, a plurality of side by side tabs supported in a rotating manner by the frame and extending through the passage port, means of kinematic connection between the tabs to ensure simultaneous and synchronised movement of each of said means between a closed position in which all the tabs are essentially coplanar and close the passage port and an open position rotated approximately 90° in relation to the closed position and characterised in that each tab is supported by the frame by means of at least one supporting plate separated by the frame and inserted in a pair of tracks formed in the frame and in that the kinematic connection means are housed in a space made in the frame and closed by the tab supporting plates.

In this manner the kinematic connection means are positioned neither in the passage port nor outside the air lock but in a dedicated space made in the air lock frame. This position ensures optimal protection of the kinematic connection means and at the same time permits perfect closing of the air lock.

To provide the housing space, the frame preferably comprises a base side perpendicular to the tabs and provided by an aluminium channel with the kinematic connection means housing space defined in the channel with the plate guide tracks formed near the channel edges.

The kinematic connection means are normally provided at only one end of the tabs. Consequently the housing space and the supporting plates can be provided on only one end of the tabs with the tab support on the other end provided in the conventional manner. However, for the sake of construction uniformity the frame comprises preferably two opposing base sides perpendicular to the tabs and provided by means of aluminium channel. Two housing spaces for the kinematic connection means are defined in the two base sides inside the channel. Two track pairs are formed on the two sides near the channel edges. Each tab is supported by the frame by means of two supporting plates separated by the frame and inserted in the track pairs. The kinematic connection means are housed in one of the two spaces.

To ensure perfect closure of the space housing the kinematic connection means the plates inserted in the tracks are in contact with each other and completely close the space in the channel.

The kinematic connection means can be of various known types. Preferably they comprise for each tab a gear wheel integral in rotation with the tab and with the gear wheel of each tab meshed directly with the gear wheel of the adjacent tabs. This embodiment permits the greatest installation simplicity with particular reference to insertion in the space created within the channel.

Advantageously end of travel stops for the tabs are formed on the supporting plates. Said stops are provided as protruding ribbings on the plates and permit improved sealing in the closed position of the tabs. Indeed, they close the space between the ends of the tabs and the frame, which space can be made minimal but not null to permit rotation of said tabs.

Preferably the supporting plates are provided in a high-resistance, low-friction polymeric material such as Nylon®.

Further characteristics and advantages of an air lock in accordance with the present invention are set forth in the description of a preferred embodiment thereof given below by way of non-limiting example with reference to the annexed drawings.

DETAILED DESCRIPTION OF THE INVENTION

Figure 1:
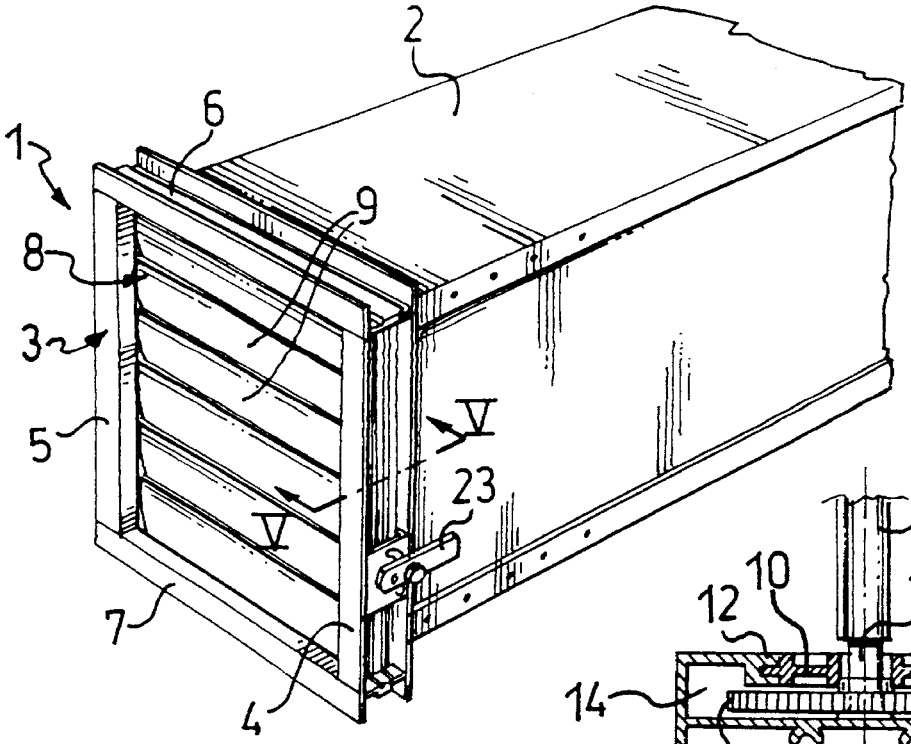
FIG. 1 shows a perspective view of an air lock in accordance with the present invention installed on a duct.
Figure 5:
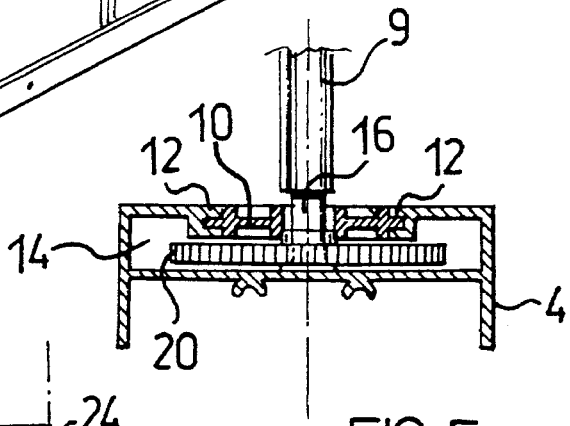
FIG. 5 shows a cross-section view of the frame side with the housing space for the kinematic connection means.
Figure 3:
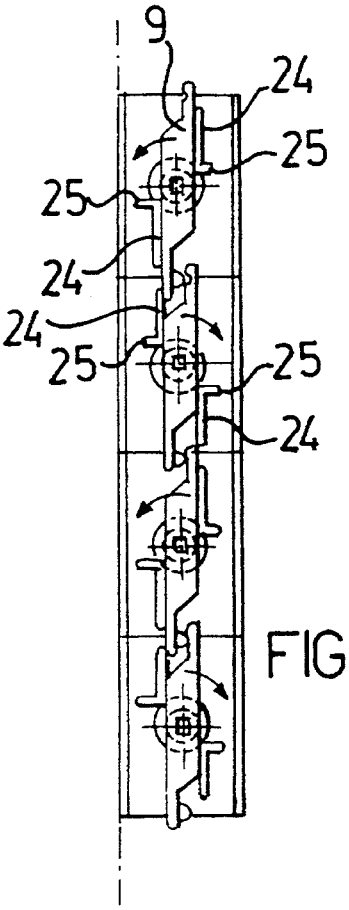
Figure 4:
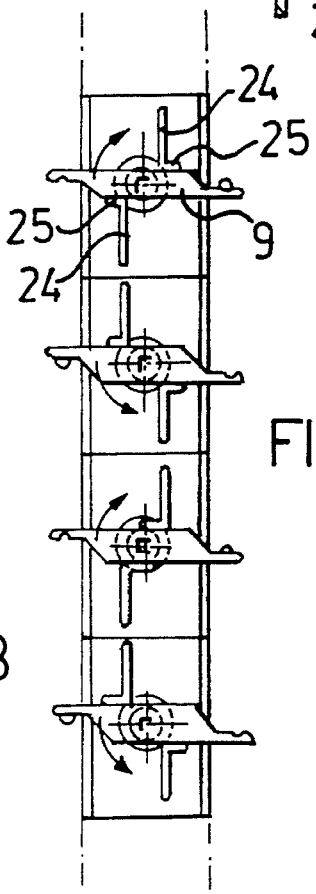
Figure 2:
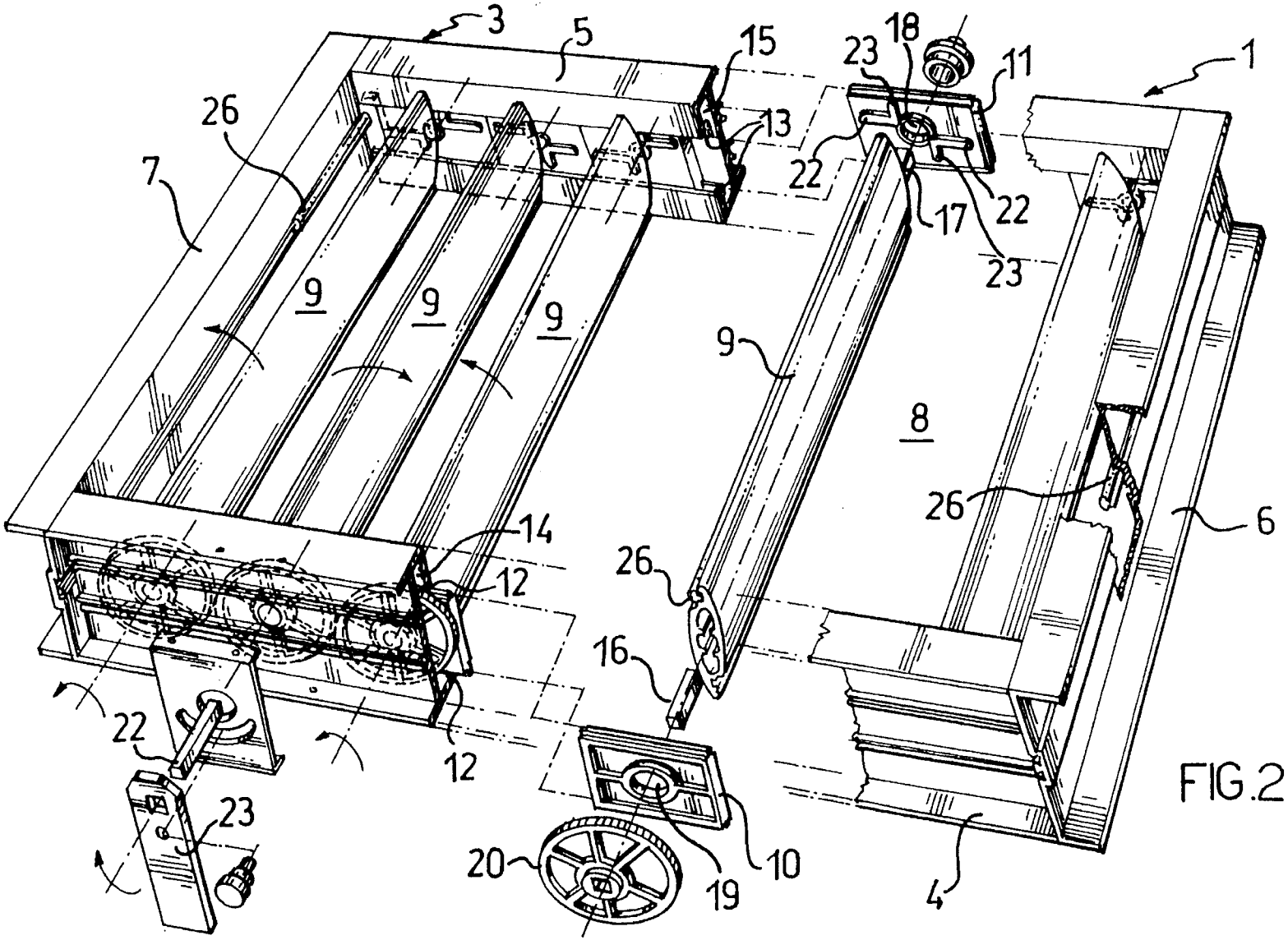
FIG. 2 shows a partially cross-sectioned exploded perspective view of the air lock of FIG. 1, FIGS. 3 and 4 show details of the air lock of FIG. 1 with the tabs in closed and open position respectively.

With reference to the figures reference number 1 indicates as a whole an air lock for closing an air duct 2. The air lock 1 comprises a rectangular frame 3 including two base sides 4 and 5 and two risers 6 and 7. With said terms it is not intended to define the operating position of the air lock 1 which could be any position depending on the arrangement of the duct 2. The frame 3 defines a passage port 8.

The air lock 1 comprises a plurality of tabs or lower blades 9 supported by the frame 3 and extending through the passage port 8 between the two base sides 4 and 5 parallel to the risers 6 and 7. The tabs 9 are supported in a rotating manner by the frame 3 (in the manner explained in detail below) between a closed position of the air lock 1 wherein all the tabs 9 are essentially coplanar and close the passage port 8 and an open position wherein each tab 9 is rotated approximately 90° in relation to the closed position.

The base sides 4 and 5 are provided by means of an aluminium section whose cross section has an essentially channel form closed towards the exterior of the frame 3 and open inwardly.

Each tab 9 is supported by the frame 3 by means of two supporting plates 10 and 11 separate from the frame 3 and inserted in track pairs 12 and 13 formed in the base sides 4 and 5 near the edges of the channel.

All the plates 10 in the tracks 12 and all the plates 11 in the tracks 13 are in contact with each other so as to completely close the channel of the respective base sides 4 and 5 to define in the frame 3 two respective spaces 14 and 15.

Each tab 9 is provided with two rotation pivots, a drive pivot 16 and an idle pivot 17. Both the pivots are integral in rotation with the tab 9 and idle in respective holes 18 and 19 formed in the plates 10 and 11.

To ensure simultaneous and synchronised movement of all the tabs 9 the air lock 1 comprises between the tabs 9 kinematic connection means housed in the space 14. Said means comprise for each tab 9 a gear wheel 20 keyed on the drive pivot 16 and hence integral in rotation with the tab 9. The gear wheel 20 of each tab 9 is meshed directly with the gear wheels 20 of the adjacent tabs 9. Consequently two adjacent tabs 9 rotate in opposite directions.

One of the gear wheels 20 is provided with a pivot 22 projecting out of the frame 3 and equipped with a lever 23 for simultaneous operation of all the tabs 9.

The plates 10 and 11 are provided with end of travel stops for the tabs 9. Said stops consist of protruding ribbings 24 and 25 formed on the plates 10 and 11. The ribbings 24 act as end of travel stops for the closed position and are thus essentially parallel to the plane of the frame 3 while the ribbings 25 act as end of travel stops for the open position and are thus essentially perpendicular to the ribbings 24. It is noted that the position of the ribbings 24 and 25 on the plates 10 and 11 depends on the direction of rotation of the tabs 9.

The ribbings 24 and 25 also permit improvement of the sealing in the closed position of the tabs 9. Indeed, they close the space between the ends of the tabs 9 and the frame 3. Said space can be minimised but not eliminated to permit rotation of the tabs 9.

Preferably the supporting plates 10 and 11 are provided in high-strength, low-friction polymeric material such as e.g. Nylon®.

The air lock 1 is then provided with sealing gaskets indicated collectively by 26 and active in closed position between adjacent tabs 9 and between the end tabs 9 and the risers 6 and 7.

In installation of the air lock 1 the two base sides 4 and 5 are fixed to the riser 6 but not to the riser 7. The tabs 9 with the pivots 16 and 17 are then fitted with their respective plates 10 and 11 and with the gear wheels 20 and then installed on the base sides 4 and 5 by inserting the plates 10 in the tracks 12 and the plates 11 in the tracks 13. The plates 10 and 11 are in mutual contact so as to close the channel of the sides 4 and 5 while the gear wheels 20 are meshed with each other. After completion of insertion of the tabs 9 the frame 3 is closed by applying the lacking riser 7.

It is noted that the kinematic connection means between the tabs 9 (the gear wheels 20) are enclosed in the space 14 protected from the air passing both through the duct 2 and from the external environment.

What is claimed is:

1. Air lock for closing ducts comprising:

a frame having two opposing base sides;

a passage port defined by said frame;

a plurality of side by side tabs supported in a rotating manner by said frame and extending through said passage port in a direction perpendicular to said base sides;

kinematic connection means connected between said tabs for simultaneous and synchronized movement of each of said tabs between a closed position in which all of said tabs are essentially coplanar and close said passage port and an open position rotated by approximately 90° in relation to the closed position;

two supporting plates for each of said tabs, said plates being separate from said frame;

two pairs of tracks formed in said base sides of said frame and housing said tab supporting plates; and two housing spaces disposed in said base sides of said frame and closed by said tab supporting plates with said kinematic connection means being housed in one of said spaces.

2. Air lock in accordance with claim 1, wherein the frame comprises a base side perpendicular to the tabs and made with an aluminium channel, the space for housing the kinematic connection means being defined within the channel, and the plate guide tracks being formed near the channel edges.

3. Air lock in accordance with claim 2, wherein the plates inserted in the same track are in mutual contact and completely close the space in the channel.

4. Air lock in accordance with claim 1, wherein the kinematic connection means comprise for each tab a gear wheel integral in rotation with the tab.

5. Air lock in accordance with claim 4, wherein the gear wheel of each tab is meshed directly with the gear wheels of the adjacent tabs.

6. Air lock in accordance with claim 1, wherein it comprises end-of-travel stops for the tabs, formed on the supporting plates.

7. Air lock in accordance with claim 1, wherein the supporting plates are provided in a high-resistance, low-friction polymeric material.

8. Air lock in accordance with claim 1, wherein the plates inserted in the same track are in mutual contact and completely close the space in the channel.

* * * * *